US005251788A

United States Patent [19]

Moore

[11] Patent Number: 5,251,788

[45] Date of Patent: Oct. 12, 1993

[54] POUR SPOUT AND DISPENSER CLOSURE WITH DRAINAGE FEATURE

[75] Inventor: David N. Moore, Plainfield, Ill.

[73] Assignee: Phoenix Closures, Inc., Naperville, Ill.

[21] Appl. No.: 872,044

[22] Filed: Apr. 23, 1992

[51] Int. Cl.[5] ..... B67D 1/16

[52] U.S. Cl. ..... 222/111; 222/147; 222/571; 215/330

[58] Field of Search ..... 222/108, 109, 111, 153, 222/481, 147, 488, 489, 544, 545, 548, 549, 570, 571; 215/202, 216, 218, 221, 330

[56] References Cited

U.S. PATENT DOCUMENTS

| | | |
|---|---|---|
| 2,601,039 | 6/1952 | Livingstone . |
| 4,460,101 | 7/1984 | Tseng . |
| 4,550,862 | 11/1985 | Barker et al. . |
| 4,671,421 | 6/1987 | Reiber et al. . |
| 4,697,722 | 10/1987 | Saito et al. . |
| 4,863,067 | 9/1989 | Krall . |
| 4,890,770 | 1/1990 | Haga et al. . |
| 4,917,268 | 4/1990 | Campbell et al. . |
| 4,917,269 | 4/1990 | Fuchs et al. . |
| 4,917,270 | 4/1990 | Simon . |
| 5,058,772 | 10/1991 | Moore et al. . |

FOREIGN PATENT DOCUMENTS

| | | |
|---|---|---|
| 0082439 | 6/1983 | European Pat. Off. . |
| 0109704 | 5/1984 | European Pat. Off. . |
| 0286843 | 10/1988 | European Pat. Off. . |
| 0348102 | 12/1989 | European Pat. Off. . |
| 1013353 | 12/1965 | United Kingdom . |

*Primary Examiner*—Gregory L. Huson
*Attorney, Agent, or Firm*—Welsh & Katz

[57] ABSTRACT

A dispenser closure for attachment to the threaded neck of a container includes a spout portion and a cap portion. The spout portion includes an annular wall, a shoulder and a depending skirt. A spout is integrally formed within the spout portion and is non-concentrically disposed with an area defined by the annular wall. The spout is substantially closed and has an inner channel which is in fluid communication with the interior of the container. The spout terminates at an upper end having an oval aperture and at a lower end at an inclined floor. A drainage opening is also formed in the spout portion and is in fluid communication with the interior of the container. The drainage opening is adjacent the annular wall and extends through the inclined floor and vertically onto the spout. The cap portion has a radially projecting annular shoulder with a depending collar. The collar is threaded on an interior surface to engage a threaded exterior surface of the upper end of the spout portion.

8 Claims, 3 Drawing Sheets

POUR SPOUT AND DISPENSER CLOSURE WITH DRAINAGE FEATURE

BACKGROUND OF THE INVENTION

The present invention relates to closures for containers designed to dispense the contents of the container by pouring, and specifically relates to a spouted closure which is securely attached to the container, which is efficient in the dispensing and drainage of the container contents, which provides a directional and controlled flow of the contents to minimize spillage and which is designed to mask orientational defects upon assembly of the closure onto the container.

Conventional dispenser closures used for pouring the container contents often consist of three components, an inner sleeve which is friction-fit to the inside of the neck of the container, a spout portion which is normally snap-fit into the sleeve so that the spout projects vertically beyond the upper margins of the sleeve and the container neck, and a cap portion which is threaded onto the neck and may serve as a measuring cup. This type of closure is commonly used for containers of liquid household laundry detergent and related liquid products, although the closure of the present invention is not restricted to any specific type of application.

One disadvantage of conventional dispenser closures is that the provision of a separate spout and sleeve requires separate tooling for its manufacture and additional labor for the assembly of the final cap. This results in a closure which is often more complicated and costly to make than desired for disposable containers. Additionally, because of the separate tooling and manufacturing steps involved, errors in the manufacturing or assembly of conventional dispenser closures often causes misalignment or orientational differences, such as the spout being improperly aligned with respect to the handle or the container mouth. Although minor, these alignment or orientational defects may result in wasteful spillage and misdirected flow of the container contents by the user. Also, the user may attempt to compensate or correct the misalignment or orientational defects by unthreading the spout portion or by holding the container differently, resulting in further spillage. An unfortunate consequence of these problems is that the user may decide to purchase a competing brand of the product even though it is not the product itself that dissatisfies them.

Another disadvantage of conventional dispenser closures is that, after pouring a portion of the contents and returning the container to an upright position, the contents may not properly drain into the container and will remain within the closure. While most conventional closures have some provision for the drainage of excess contents of the container back into the container, it is common for excess liquid to be retained on the exterior of the neck, and in the interior of the cap, creating a slippery and messy condition and making the container unpleasant to use. Further, when the container is already empty, the design of the inner sleeve often prevents the emptying of the entire contents of the container, thus perpetually trapping a residual amount of the contents in the container. This creates a frustrating situation for the user and results in an unnecessary waste of contents. Finally, currently known available dispenser closures utilize spout and drainage configurations that are not necessarily directed at increasing the control and direction of the flow of the contents from the container to minimize wasteful and messy spillage.

Thus, there is a need for a container closure which is preassembled with a spout portion so that additional labor is not required for assembling the spout portion into the sleeve. Furthermore, there is a need for a container closure which is designed to mask orientational defects and misalignments, which insures that the user can not improperly pour the contents even when there are orientational defects in the closure and which has optimum draining capabilities so that the contents are not retained in the spout area or within the cap. Additionally, there is a need for a closure which facilitates the dispensation of the entire contents of the container and provides for increased control and direction over the flow of the contents from the container.

SUMMARY OF THE INVENTION

Accordingly, the dispenser closure of the present invention provides a two-piece closure including a preassembled spout portion which is threaded onto the container neck and is configured for locking engagement therewith. The spout portion has provisions for the drainage of any excess material back into the container. The spout portion further includes a spout formation that increases the user's ability to control and direct the flow of the contents from the container, minimizes the potential for spillage of the contents due to configuration defects in the closure and masks minor orientational or alignment defects between the spout portion and the container. Further, the cap portion includes a depending collar with shielded threads to prevent their exposure to the contents of the container during pouring when the cap is used as a measuring cup.

More specifically, the present dispenser closure includes a spout portion having an annular wall provided with a lower end, a central part and an upper end. The central part having a radially projecting peripheral shoulder with a depending skirt. The skirt being threaded on an interior surface for engagement with the exterior threads on the neck of the container. The upper end of the wall is threaded on an exterior surface. The spout portion also has an integral spout formation having a generally elongated or frusto-conically shaped body portion, an upper portion and a lower portion.

The body portion of the spout is closed from the upper portion to the lower portion adjacent an inclined floor and a drainage formation. The upper portion terminates along an edge which defines a mouth, or a generally oval aperture, which is in fluid communication with an inner channel of the body portion. The inner channel is fluid communication with the interior of the container and generally follows the width of the body portion. The spout formation can extend beyond the height of the annular wall and may be non-concentrically located with respect to the interior of the annular wall and the container mouth.

Between the spout formation and the annular wall there is formed an inclined floor or gutter formation that gradually declines until terminating at a drainage formation. The drainage formation is preferably aligned with the spout formation and is in fluid communication with the spout formation and the inclined floor to facilitate the drainage of any residual material from the container out the end of the spout formation. Also included is a drain flow opening, which is configured to aid in the egress of the container contents. A cap portion includes a generally tubular wall with a lower end having a radially projecting annular shoulder with a depending collar, the collar being threaded on an interior surface to engage the threaded exterior surface of the upper end of the wall.

DESCRIPTION OF THE PREFERRED EMBODIMENT

Figure 1:
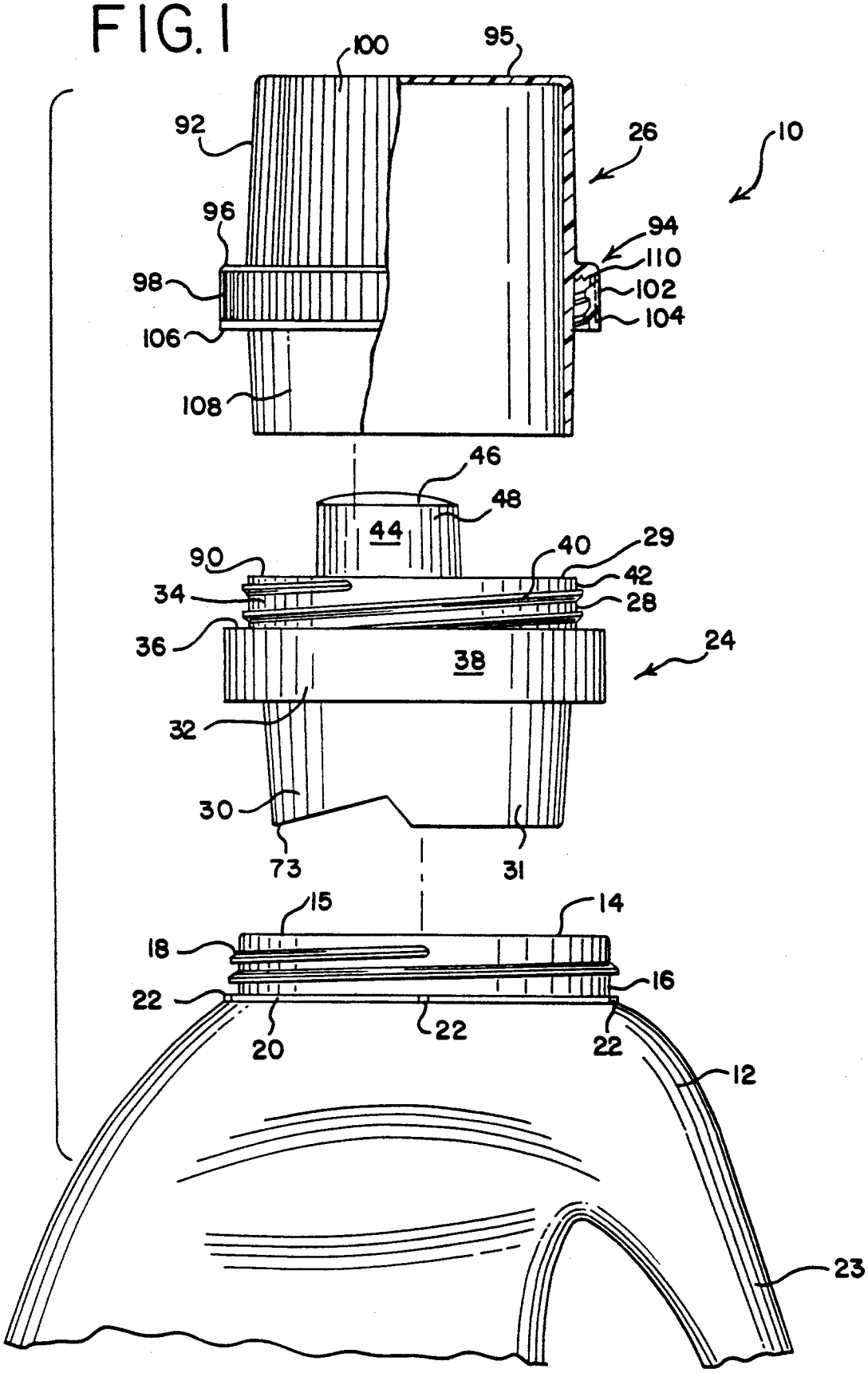
FIG. 1 is an exploded side elevational view of the closure of the invention and a corresponding container.

Referring now to FIG. 1, the closure of the present invention is generally designated as 10 and is shown exploded from a typical container 12. The container 12 includes a mouth 14, an upper edge 15, and a neck 16 having threads 18 on an exterior surface thereof. A radially projecting peripheral shoulder 20 is located at the base of the neck 16 and may be provided with a plurality of locking formations 22. The container 12 will typically include a handle formation 23 to facilitate holding the container or when pouring the contents out from the container. The container 12 may be manufactured of a suitable polymeric material, but the specific material used depends on the substance which is held within the container 12.

The closure 10 in essentially a two piece assembly. The closure 10 has a spout portion 24 and a separate cap portion 26. The spout portion 24 and the cap portion 26 may be made of a suitable polymeric material. The spout portion 24 has an annular wall 28 with a lower end 30, a central part 32 and an upper end 34. The annular wall 28 terminates at one end as an upper edge 29. The lower end 30 is dimensioned to be inserted into the mouth 14 and may be provided with at least one, and preferably two, leveling legs 31. A radially projecting peripheral shoulder 36 is located at the central part 32 and is provided with a depending skirt 38. The skirt is provided with threads 40 on an interior surface 42 (best seen in FIG. 5), which are configured to threadably engage the threads 18 on the container neck 16.

Figure 2:
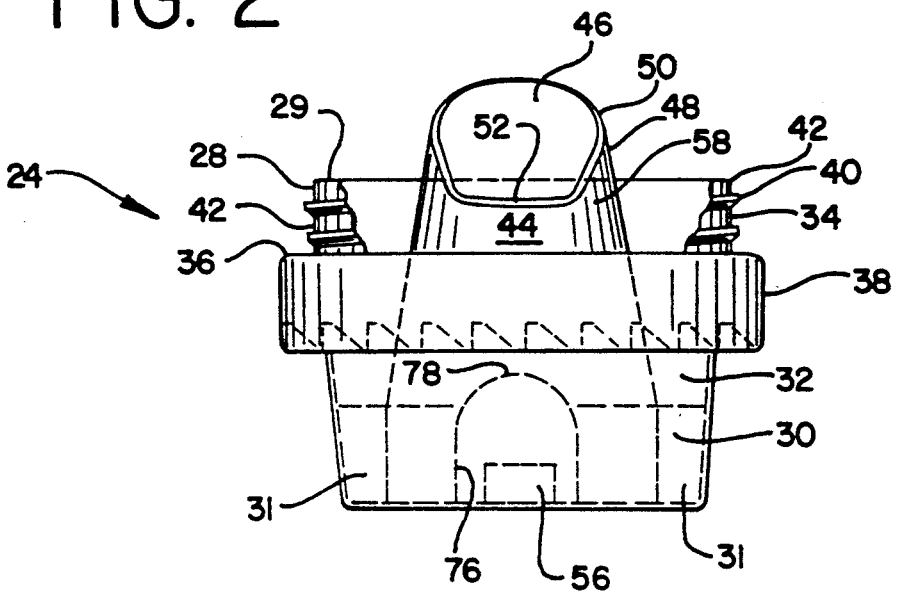
FIG. 2 is an side view of the spout portion of the closure shown in FIG. 1 with an alternative mouth configuration and with portions broken away for clarity.
Figure 3:
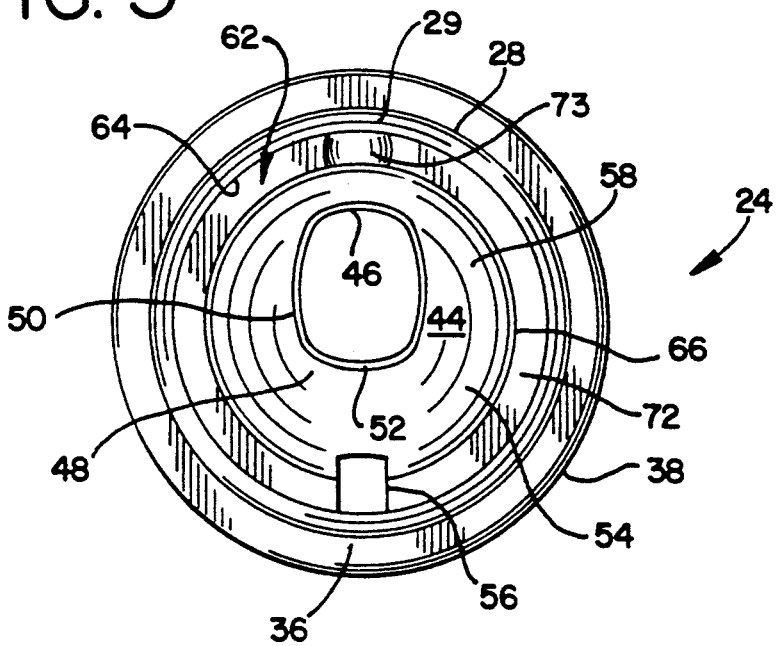
FIG. 3 is an overhead plan view of the spout portion shown in FIG. 1.
Figure 4:
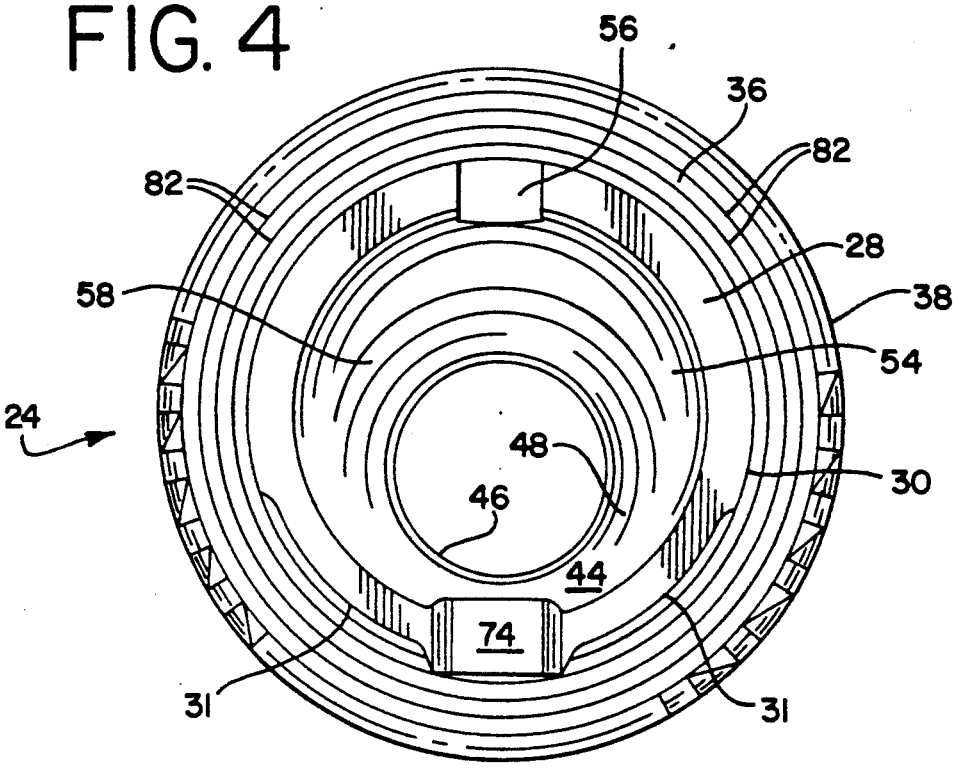
FIG. 4 is a bottom plan view of the spout portion shown in FIG. 1.

Referring to FIGS. 2 through 4, a spout formation 44 is integral with the spout portion 24 and is preferably molded as part of the spout portion 24. The spout formation 44 includes a channel 46 which provides fluid communication with the interior of the container 12 and is disposed through the length of the spout formation 44. The spout formation 44 has an upper portion 48 terminating at an upper edge 50, which is substantially oval or circular in formation and may be tapered to help prevent spillage when pouring the contents Alternatively, the upper edge 50 may also be configured having a slanted or semi-circular formation, as shown in FIG. 2. If configured as an oval or a circle, the upper edge 50 will have a point 52, which is situated directly above a drainage formation 56. It is preferred that the upper edge 50 be oval in shape to aid in directing the fluid flow of the container contents and to minimize spillage which may result with other shapes. Further, the oval shape more closely matches the frusto-conical configuration of the spout formation 44 to further increase pouring efficiency for the user. The upper portion 48 may extend beyond the height of the upper end 34 of the annular wall 28.

The spout formation 44 also has a lower portion 54 which is substantially adjacent the drainage formation 56 and a floor 72 along its lowest edge. Spout formation 44 also includes a central body portion 58 which is substantially closed about its axis from the upper edge 48 to the lower portion 54. The body portion 58 forms the outer structure for channel 46, and although substantially closed, may include a portion of the drainage formation 56. The body 58 is generally frusto-conical or elongated in shape. As shown, the spout formation 44 is preferably disposed in a non-concentric orientation or off-centered with respect to an interior portion 60 of the annular wall 28 and the container mouth 14. As shown best in FIG. 1, the spout formation 44 is non-concentrically oriented within the interior portion 60 of the annular wall 28 so that the spout formation 44 is directed away from the handle 23. For containers that do not utilize a handle formation, the spout formation 44 should be disposed within the interior portion 60 towards the portion of the container designed or designated to be the pouring side. However, it should be understood that, although this orientation of the spout formation 44 with respect to the interior portion 60, minimizes spillage and increases the control of the fluid stream during pouring, the presently described spout formation 44 is configured so that it can be oriented differently without significantly impairing these advantages.

The frusto-conical shape for the spout formation 44 is preferred because it provides for an increased directional flow of the container contents and fluidly cooperates with the preferred oval shape of the upper edge 50. Together, the frusto-conically shaped body 58 and the oval shaped upper edge 50 gives the user more control over the fluid stream of the contents poured from the container 12. Essentially, the frusto-conical shape allows for a more consistent flow of contents through the channel 46 because the lower portion 56 can accept a large quantity of the contents, while the upper portion 48 constricts the flow to create a steady, directional stream of the contents. Further, because the body 56 is substantially closed, the spout formation 44 prevents the user from pouring the contents out improperly regardless of how the container 12 or the handle 23 is held or oriented by the user. Further, because the spout formation 44 is substantially closed, alignment or orientational defects will be masked from the user, thereby facilitating the proper pouring of the contents by the user, while minimizing spillage. Lastly, because of the non-concentric orientation of the spout formation 44 with regards to the interior portion 60, the container mouth 14 and the handle 23, the user is further prevented from pouring the contents improperly. This particular arrangement of the spout formation 44 causes the frusto-conically shaped body 58 to be directed or disposed away from the handle 2 to increase the pouring angle, the consistency of the fluid stream and the amount of ventilating air that enters the container 12. Additionally, the non-concentric orientation of the spout formation 44 will help to conceal misalignment or orientational defects so that the user does not attempt to realign or entirely disregard the spout portion 24.

Figure 5:
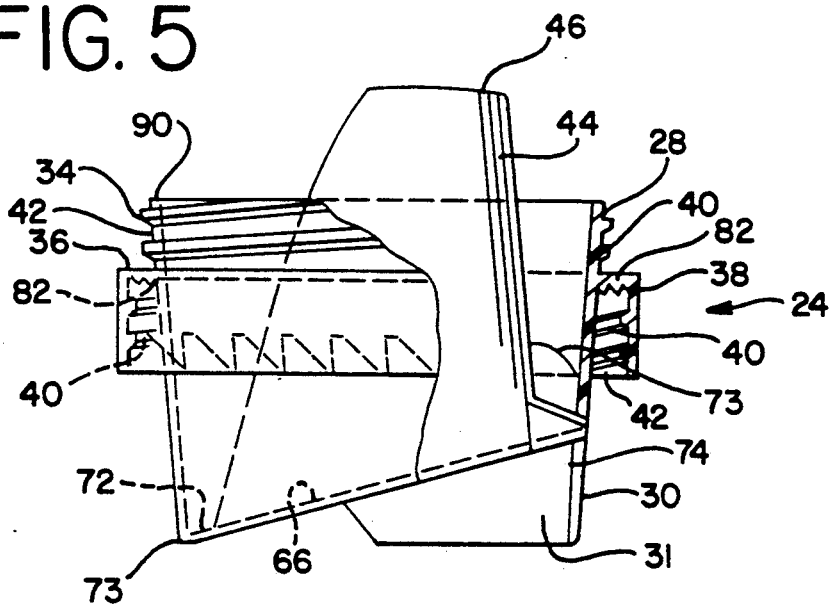
FIG. 5 is a vertical sectional view of the spout portion shown in FIG. 1 with portions broken away for clarity.

Referring now to FIGS. 3 through 5, the spout portion 24 is shown in greater detail. The annular wall 28 defines an interior portion 62 having an inner surface 64 which terminates at a base 66. The base 66 is preferably inclined and configured so as to be integral with a floor 72 of the spout portion 24. The floor 72 is situated between the base 66 and the lower portion 54 of the spout formation 44, and is substantially continuous therein between except for the drainage formation 56. The drainage formation 56 is generally formed through the floor 72 and extends vertically up onto a section of the lower portion 54 of the spout formation 44. It is preferred that the drainage formation 56 be formed at the lowermost point along the incline of the floor 72. The floor 72 is inclined to enable the drainage of any excess or residual material, from the spout formation 44 back into the container 12 once the container resumes its normal vertical post-pouring position. Thus, the opposing sides of the floor 72 terminate at the drainage formation 56. For this reason, the floor 72 actually acts as a gutter or trough to catch liquid draining from the spout formation 44 or the inner surface 64 of the wall 28 and to enable that liquid to flow downward along the floor 72 and through the drainage formation 56 into the container 12. The leveling legs 31 form a tripod with a lower end 74 of the floor 72 to maintain the spout portion 24 in an upright position, thus facilitating manipulation by vertically-oriented automatic handling equipment.

In order to prevent the retention of container contents within the spout portion 24 when the container 12 is inverted in a pouring position, the annular wall 28 may also be provided with an additional drain flow opening 76 which is in fluid communication with the spout formation 44 and the interior of the container 12. The opening 76 preferably has an upper end 78 which is substantially coextensive with the lower edge of the skirt 38. In this manner, when the container 12 is inverted for pouring, any residual liquid will be able to flow through the opening 76 and out the spout formation 44. The opening 76 is preferably located opposite the drainage formation 56. The upper end 70 may actually come through the floor 72 forming an arc-like bulge 73 at the highest point or the origin of the inclinal floor 72. The bulge 73 also acts to increase the flow of the contents down the inclined floor 72 and into the drainage formation 56.

It is contemplated that the drainage formation 56 will be substantially rectangular or circular in shape, but other configurations not herein specifically disclosed can be utilized without departing from the principles of the present closure 10. As shown most clearly in FIGS. 3 and 4, the drainage formation 56 extends from an outer most point adjacent the inner surface 64 or base 66, through the floor 72, and up onto the lower portion 54 of the spout formation 44. This particular arrangement of the drainage formation 56 increases the consistency of the flow, in terms of the egress speed and quantity, when the user tilts or inverts the container 12 to use the product. The drainage formation 56 accomplishes this by permitting a steady stream of ventilating air to enter the container 12 when the container 12 is tilted over or inverted by the user. As the contents of the container 12 are dispensed, the drainage formation 56 permits ventilating air to enter the container and fill the empty space, thereby causing the contents to be pushed or forced out of the container 12. Because the drainage formation 56 extends onto the spout formation 44, as the container 12 is further inverted by the user, an increased amount of air enters the container to increase the quantity of dispensation, while maintaining a steady, consistent flow. Accordingly, the present drainage formation 44 serves a dual purpose. First, it provides a draining system for the return of unused material back into the container 12. Secondly, it functions to allow a steady stream of ventilating air into the container 12 to help force the contents out.

As shown in FIGS. 2 and 5, the interior surface 42 of the skirt 38 can include a plurality of ratchet teeth 80. The ratchet teeth 80 are configured to engage the locking formations 22 as the spout portion 24 is threaded upon the neck 16 of the container 12. Although the threads 40 of the skirt 38 and the threads 18 of the neck 16 are designed to be of the conventional clockwise or right-hand type, it is also contemplated that these threads may be of the counterclockwise or of the left-hand type. The shoulder 36 can also include at least one annular sealing rib 82 (best seen in FIG. 5), which provides a more secure seal between the spout portion 24 and the container neck 16.

Referring again to FIG. 1, the cap portion 26 includes a closed top 90, a generally tubular wall 92 depending from the top and having a lower end 94, the lower end being provided with a radially projecting annular shoulder 96 having a depending collar 98. To enhance the user's grip of the closure 10, the tubular wall 92 may include a plurality of spaced, generally parallel, external gripping ribs 100. The collar 98 is provided with threads 102 on an interior surface 104. The threaded interior surface 104 is configured to threadably engage the exterior surface 42 of the wall 28.

It is shown that in the cap portion 26, the tubular wall 90 at its lower end 94 projects vertically downward below a lower edge 106 of the collar 98. The projecting portion 108 is preferably dimensioned to slidingly engage the inner surface 64 of the spout portion 24. Thus, if the cap portion 26 is used as a measuring cup for the contents of the container 12, when the contents are poured from the cap 26, the threads 102 on the collar 98 will not be exposed to the container contents. The external location of the threads 40 on the spout portion 24 also prevents their exposure to the container contents. The annular shoulder 96 may also be provided with at least one annular sealing rib 110 which provides a more secure seal between the cap portion 26 and the annular wall 28.

Assembly of the closure 10 to the container 12 is simple and efficient The container 12 is first filled with the specified contents, normally a liquid. Next, the preassembled, integral spout portion 24 is threaded upon the threaded neck 16 of the container 12. In the preferred embodiment, during this threading action, the ratchet teeth 80 engage the locking formations 22 to prevent the subsequent, undesired removal of the spout portion during shipment or use of the container 12. In addition, the sealing ribs 82 engage an upper edge 15 of the neck 16 to prevent the leakage of container contents. Once the spout portion 24 is secured to the container 12, the cap portion 26 is threaded upon the spout portion 24 so that the threads 102 of the collar 98 engage the external threads 40 of the upper end 34 of the annular wall 28. When the cap portion 26 is tightly threaded onto the spout portion 24, the sealing rib 110 is placed in a contact relationship with the annular wall 28 to prevent the leakage of container contents The configuration of the present closure 10 allows the cap portion 26 and the spout portion 24 to be preassembled at a remote location and subsequently threaded upon the container in one piece.

In operation, when the container 12 is inverted to pour the contents therefrom, the contents may easily flow through the flow opening 76 and out the spout formation 44. If the cap portion 26 is used as a measuring cup, the extension 106 of the extended lower end 92 prevents the leakage or dripage of the contents into the threads 102 of the collar 98. Thus, the external threads 40 of the surface 42 remain relatively free of container contents. Accordingly, the user will benefit because the configuration of the closure 10 helps to eliminate wasteful and messy spillage.

The features of the present closure 10, particularly the spout formation 44 and the drainage formation 56 as described herein, provide additional advantages. The arrangement of the spout formation 44 in relation to the annular wall 28, the drainage formation 56 and the container mouth 14 increases the user's ability to control and direct the flow of the contents when the user inverts or angles the container 12 to utilize the product. Additionally, because of the location of the drainage formation 56 with respect to the floor 72 and the spout body 58, the quantity and speed of the flow of the contents is more consistent.

Yet another advantage of the present closure 10 is the configuration of the spout formation 44 itself. Since the preferred spout formation 44 is substantially unitary or closed, manufacturing abnormalities or defects that would otherwise cause the spout portion 24 and the spout formation 44 to be misaligned or improperly oriented with respect to the container 12 can be sufficiently masked from the user. The threads 18 and 38 are configured and arranged so that the spout formation 44 aligns correctly with respect to the handle 23 when secured on the neck 16. Typically, the spout formation 44 is properly oriented when it is directed away from the handle 23 of the container 12. Defects, such as a deformation of the threading on either the container neck 16 or the skirt 38 of the spout portion 24, can cause the spout formation 44 to be misaligned when fully assembled onto the container 12. The user may then manually adjust for the misalignment, by inverting or angling the container 12 in ways that will cause wasteful and messy spillage of the contents. The user may also attempt to realign the spout formation 44 onto the container 12 by unthreading or loosening the spout portion 24 until the spout formation 44 does align properly. This may result in the leakage of the contents or even substantial amounts of spillage and loss of the contents if the spout portion 24 eventually becomes unsecured from the container 12. However, an advantage of the present configuration of the spout formation 46 is that if the threading 18 and 38 do not properly align when the spout portion 24 is fully secured onto the container neck 16, then the spout formation 44 will override the faulty orientation and conceal the defect from the user.

Additionally, since the spout portion 44 is substantially closed from the upper portion 48 to the lower portion 54, the upper edge 50 is oval and the body 56 is generally frusto-conical, the flow of the contents can be controlled and directed more effectively by the user. The configuration of the closure 10 as described herein provides the user with a dispensing unit which obviates messy and wasteful spillage, and thereby possibly contributes to the user's desire to purchase that specific product again.

While a particular embodiment of the dispenser closure of the invention has been shown and described, it will be appreciated by those skilled in the art that changes and modifications may be made thereto without departing from the invention in its broader aspects and as set forth in the following claims.

What is claimed is:

1. A dispenser closure for a container, the container having an interior being adapted to house fluid contents and having a threaded neck portion and a mouth portion terminating at an upper edge, the closure comprising:

a spout portion having an annular wall provided with a lower end, an interior surface, a central part and an upper end, said lower end dimensioned for insertion into said neck, said central part having a radially projecting peripheral shoulder with a depending skirt, said skirt being threaded on an interior surface, said threaded surface configured to threadably engage the neck of the container, said upper end of said annular wall having threads formed on an exterior surface;

a generally frusto-conically shaped spout being integral with said spout portion, said spout being generally non-concentrically disposed within said interior of said annular wall, said spout having an upper end and a lower end, said upper end terminating at an aperture, said aperture being substantially the diameter of said upper end of said spout formation, said lower end terminating at an inclined floor disposed between said spout and said interior of said annular wall;

said inclined floor having an uppermost point and a lowermost point;

a drainage opening formed substantially through said lowermost point of said inclined floor adjacent to said interior of said annular wall, said drainage opening extending vertically through a portion of said lower end of said spout;

said spout being substantially closed from said upper end to said lower end, said spout having an inner channel in fluid communication with said aperture, said drainage opening and the interior of the container; and a cap portion having means for threadably engaging said upper end of said annular wall.

2. The closure as defined in claim 1 wherein said aperture is generally oval.

3. The closure as defined in claim 1 wherein said drainage formation is configured and arranged relative to said interior of said annular wall, said inclined floor and said spout to provide drainage of the contents back into the container when said container is returned to an upright position after being inverted, said drainage formation also providing a passageway for ventilation of the container to increase the egress speed and flow consistency when the user inverts the container to pour the contents.

4. The closure as defined in claim 1 wherein said spout portion includes an integral flow opening being in fluid communication with said spout and the interior of the container for increasing the flow of the container contents when the container is inverted for pouring.

5. The closure as defined in claim 1 wherein said interior of said annular wall terminates at an inclined base.

6. A dispenser closure for a container, the container having an interior being adapted to house fluid contents and having a threaded neck portion and a mouth portion terminating at an upper edge, the closure comprising:

a spout portion having an annular wall provided with a lower end, an interior surface, a central part and an upper end, said lower end dimensioned for insertion into said neck, said central part having a radially projecting peripheral shoulder with a depending skirt, said skirt having means for engaging the neck of the container;

a generally frusto-conically shaped spout being integral with said spout portion, said spout being generally non-concentrically disposed within said interior of said annular wall, said spout having an upper end and a lower end, said upper end terminating at an aperture, said aperture being generally oval and being substantially the diameter of said upper end of said spout, said lower end terminating along an inclined floor disposed between said lower end of said spout and said interior of said annular wall;

said inclined floor having an uppermost point and a lowermost point;

said spout being substantially closed from said upper end to said lower end, said spout having an inner channel in fluid communication with said aperture, said drainage opening and the interior of the container, said inner channel being substantially the width of said spout; and a drainage opening formed substantially through said lowermost point of said inclined floor adjacent to said interior of said annular wall, said drainage opening extending up into and through a portion of said lower end of said spout and being in fluid communication with said inner channel of said spout;

a cap portion having means for threadably engaging said upper end of said annular wall.

7. The closure as defined in claim 6 wherein said drainage formation is configured and arranged relative to said interior of said annular wall, said inclined floor and said spout to provide drainage of the contents back into the container when said container is returned to an upright position after being inverted, said drainage formation also providing a passageway for ventilation of the container to increase the egress speed and flow consistency when the user inverts the container to pour the contents.

8. The closure as defined in claim 6 wherein said spout portion includes an integral flow opening being in fluid communication with said spout and the interior of the container for increasing the flow of the container contents when the container is inverted for pouring, said flow opening being diametrically opposed from said drainage opening.

* * * * *